US007937785B2

(12) United States Patent
Stimpson et al.

(10) Patent No.: US 7,937,785 B2
(45) Date of Patent: May 10, 2011

(54) PUMPED SHOWER DRAINING DEVICE

(75) Inventors: Robert William Stimpson, Douglas (GB); Ian Felmeri, Castletown (GB)

(73) Assignee: DLP Limited, Isle of Man, British Isles (GB)

( * ) Notice: Subject to any disclaimer, the term of this patent is extended or adjusted under 35 U.S.C. 154(b) by 664 days.

(21) Appl. No.: 12/046,937

(22) Filed: Mar. 12, 2008

(65) Prior Publication Data

US 2008/0222799 A1 Sep. 18, 2008

(30) Foreign Application Priority Data

Mar. 17, 2007 (GB) ..... 0705168.3

(51) Int. Cl.
*A47K 4/00* (2006.01)

(52) U.S. Cl. ..... 4/665; 4/613; 417/223; 417/319; 192/58.62

(58) Field of Classification Search ..... 4/613, 665; 192/58.61; 417/223, 319
See application file for complete search history.

(56) References Cited

U.S. PATENT DOCUMENTS 4,271,945 A * 6/1981 Budinski ..... 192/58.61
5,345,625 A * 9/1994 Diemand ..... 4/665
6,021,747 A * 2/2000 Gee et al. ..... 123/41.12
6,314,625 B1 * 11/2001 Ikeda ..... 24/429
6,725,812 B1 * 4/2004 Scott ..... 123/41.44
6,725,813 B1 4/2004 Boyer
7,581,627 B2 * 9/2009 McDermott et al. ..... 192/58.61
2007/0022979 A1 2/2007 Gradu et al.

FOREIGN PATENT DOCUMENTS

| | | | |
|---|---|---|---|
| GB | 2310 374 | A | 8/1997 |
| GB | 2 355 653 | A | 5/2001 |
| GB | 2 361 419 | A | 10/2001 |
| GB | 2 421 055 | A | 6/2006 |
| GB | 2 424 368 | A | 9/2006 |
| WO | WO 2005/059259 | A1 | 6/2005 |
| WO | WO 2006/119951 | A1 | 11/2006 |

OTHER PUBLICATIONS

European Search Report for EP 08250830.

* cited by examiner

*Primary Examiner* — Charles Phillips
(74) *Attorney, Agent, or Firm* — Martin Fleit; Paul D. Bianco; Fleit Gibbons Gutman Bongini & Bianco PL

(57) ABSTRACT

A pumped shower draining device for a shower installation, comprises a housing having a waste water inlet and a waste water outlet, a pump element provided within the housing, a pump driving device for driving the pump element, and a variable-engagement clutch for providing variable driving engagement between the pump driving device and the pump element. An amount of engagement imparted by the in use clutch is determined by an amount of waste water flowing from a shower unit of the shower installation. Preferably, the clutch is self-regulating, so that the amount of engagement is determined by an amount of water in or at the clutch.

12 Claims, 1 Drawing Sheet

PUMPED SHOWER DRAINING DEVICE

BACKGROUND OF THE INVENTION

The present invention relates to a pumped shower draining device.

Various attempts have been made in the past to regulate the speed of a shower drain pump to that of the water entering the waste, such that the shower base or tray is effectively drained and does not flood. Frequently, this has relied upon an electronic flow sensor or sensors in the water supply pipe or pipes to the shower unit, and an electrical or electronic control system which matches the sensed flow rate entering the shower unit to the pumping capacity of the shower drain pump.

This method requires extensive and often sophisticated electronics control systems, as typified by the Digipump control system supplied by DLP Limited of Snugborough, Isle of Man.

This known arrangement requires flow sensors to be placed in all water supply pipes to a shower water heater. The electronics detects the output of the flow sensors through electric cable connections which must be run from the shower inlet to the electronics controller, which for various safety and regulatory reasons must be located a distance from the shower area. The electronics compares the detected flow rate to a pre-stored performance curve of pump speed and voltage applied to pumping capacity, and issues a pump motor control voltage to operate the pump, hopefully matching the pump performance to the flow rate of the incoming water to the waste.

Such flow sensors typically also require fine particulate filters on the supply line to them, due to the small clearances between internal components located in the water flow, and are precision instruments of often high cost, requiring sensitive installation, which may not always be carried out by installers.

Other known systems rely upon a flow switch to start and stop a drain pump, with various types of regulatory control electronic or electric controls, incorporating various degrees of what is effectively artificial intelligence programmed in to them as computer logic controls within embedded microprocessors or programmable logic controllers. These are often complex, expensive and of variable reliability and robustness.

The present invention seeks to overcome these problems.

SUMMARY OF THE INVENTION

According to the present invention, there is provided a pumped shower draining device for a shower installation, the pumped shower draining device comprising a housing having a waste water inlet and a waste water outlet, a pump element provided within the housing, a pump driving device which can drive the pump element, and a variable-engagement clutch which provides variable driving engagement between the pump driving device and the pump element, wherein an amount of engagement imparted by the in use clutch is determined by an amount of waste water flowing from a shower unit of the shower installation.

The invention will now be more particularly described, by way of example only, with reference to the accompanying drawing.

DESCRIPTION OF THE PREFERRED EMBODIMENTS

Figure 1:
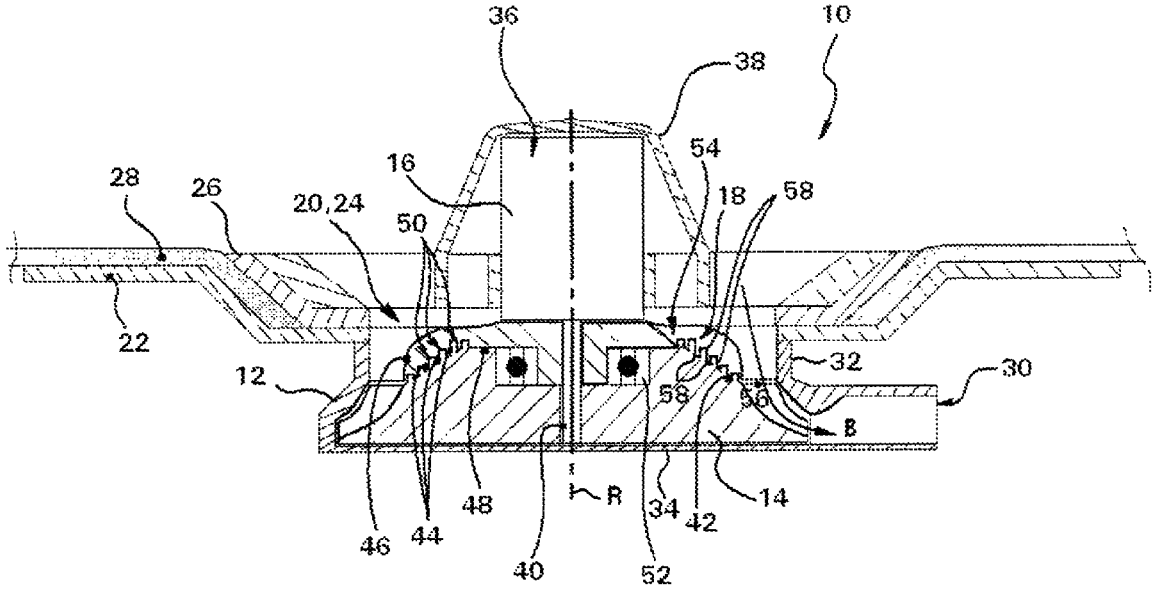
FIG. 1 shows a side cross-sectional view through a shower-floor former, and showing one embodiment of a pumped shower draining device in accordance with the present invention.

Referring to the drawing, there is shown a pumped shower draining device 10 for a shower installation. The pumped shower draining device 10 comprises a housing 12, a pump element 14 providing within the housing 12, a pump driving device 16, and a self-regulating variable-engagement clutch 18 for providing variable driving engagement between the pump driving device 16 and the pump element 14.

In this embodiment, the housing 12 is directly connected to a recessed waste aperture 20 of a shower-floor former 22. As such, the waste aperture 20 forms a waste water inlet 24 of the housing 12.

The waste aperture 20 is recessed to accept a clamping ring 26. Once in position, flexible plastics waterproof floor covering material 28 can be laid across the former 22 and clamped in place by the clamping ring 26 at the recessed waste aperture 20.

The housing 12 also includes a waste water outlet 30, in use connected to a drain. In this case, the waste water outlet 30 is formed in a side 32 of the housing 12 and spaced below the waste water inlet 24. However, the waste water outlet 30 can be formed in a base 34 of the housing 12.

The pump element 14 is rotatably supported in the housing 12, on the base 34 thereof The pump element 14 is an impeller for forcing waste water through the waste water outlet 30 and thus to the drain.

The pump driving device 16 is typically an electric motor 36. The motor 36 is provided in a waterproof motor housing 38, which projects from the recessed waste aperture 20 of the former 22. Electrical cables to energise the motor 36 are preferably run beneath the former 22 to a suitable power supply. Basic control circuitry for controlling the motor 36 can be provided either on-board the motor 36, within the motor housing 38, or remote from the motor 36. The control circuitry typically energises the motor 36 when water begins flowing from the shower unit, either immediately or after a pre-set time interval, and then deenergises the motor 36 when water flow stops, again either immediately or after a predetermined time interval. Energisation and deenergisation of the motor 36 can typically be effected by a flow switch or sensor at the shower unit and hard-wired or in wireless communication with the control circuitry of the motor 36. Alternatively, a user-operable switch can be provided at or in the vicinity of the showering area.

Although further control can be provided, it is not necessary.

An output shaft 40 of the motor 36 projects into the housing 12, and the pump element 14 is conveniently mounted on the output shaft 40 for rotation thereon.

The clutch 18 is interposed between the pump driving device 16 and the pump element 14, on a flow path defined in the housing 12 between the waste water inlet 24 and the waste water outlet 30.

In this embodiment, the clutch 18 is a viscous coupling. The pump element 14 includes a sloping, preferably frusto-conical, upper surface 42 with a plurality of radially-spaced concentric first rings 44 upstanding thereon. The first rings 44 project upwardly in parallel with a rotational axis R of the pump element 14.

The clutch 18 also includes a disk element 46 which is angularly fixed to the output shaft 40 of the motor 36 of the pump driving device 16, for example by splines or keying. A lower surface 48 of the disk element 46 includes a plurality of radially-spaced concentric second rings 50 depending therefrom. A bearing 52 is provided between the disk element 46 and the pump element 14. The first and second rings 44, 50 are coaxial and project sufficiently so as to alternate in parallel with each other when the disk element 46 is supported by the bearing 52.

To allow waste water to flow in between the adjacent surfaces of the first and second rings 50, apertures 54 are formed in the disk element 46.

To then allow waste water to adequately drain from between the adjacent surfaces of the first and second rings 44, 50, one or more radial drain channels (marked by an arrow referenced as 56) are provided through the first and second rings 44, 50, either by notching the first and second rings 44, 50, or by including complete breaks in the circumference of the first and second rings 44, 50. This, in conjunction with the slope of the upper surface 42 of the pump element 14, allows water to drain from the clutch 18 towards the base 34 of the housing 12.

The flow path through the housing 12 includes a bypass portion B which bypasses the clutch 18. This allows excess waste water to flow freely from the waste water inlet 24 to the waste outlet. Typically this water is entrained by the water being pumped by the pump element 14.

To prevent or reduce the chance of blockage through detritus and other particulate matter, such as hair and skin, one or more of the first and/or second rings 44, 50 can include a cutting and/or grinding edge 58. The edge 58 may be directed to be parallel with the rotational axis R of the pump element 14, or formed as an inwardly and/or outwardly turned lip which projects transversely to the rotational axis of the pump element 14. The or each cutting and/or grinding edge 58 therefore macerates the detritus and particulate matter entering the housing 12.

The use of the viscous coupling described above provides a self-regulating variable-engagement clutch 18 between the pump driving device 16 and the pump element 14. As waste water begins to flow into the housing 12, through the waste water inlet 24, it enters space between one or some of the adjacent surfaces of the first and second rings 44, 50. Drag is thus imparted on the already rotating second rings 50 by the stationary or substantially stationary first rings 44. Frictional engagement between the first and second rings 44, 50 thus occurs via the liquid therebetween, causing the first rings 44 and thus the pump element 14 to rotate at a rotational speed which is, at least initially, typically less than that of the second rings 50.

As more water enters the housing 12, and thus more space S between adjacent surfaces of the first and second rings 44, 50 is filled, the rotational speed of the first rings 44, and thus also of the pump element 14, increases.

As the flow of waste water tails off, for example, once showering has finished, the water between the adjacent surfaces of the first and second rings 44, 50 drains away, thus allowing the first rings 44 to slip relative to the second rings 50. Consequently, the pump element 14 slows.

Although a viscous coupling is described above, the variable-engagement clutch can take other forms. For example, although not shown, the clutch can include a mechanical drive mechanism which can engage and disengage the pump driving device and the pump element, and a float. The float is provided within the housing such that, as waste water flows into the housing, the float rises and causes the drive mechanism to engage the pump driving device and the pump element, allowing the pump element to be driven. This initial engagement can be partial, so that as a greater volume of water enters the housing, the float rises further, allowing greater or full engagement between the pump driving device and the pump element.

By providing a clutch which permits limited slip between the pump driving device and the pump element, the pump element can be driven at a speed which is preferable for a volume of water to be pumped.

The viscous coupling, in particular, has only a few parts, none of which are complex or prone to breakage, thus making this arrangement particularly suitable for use in the relatively harsh environment of a pumped shower drain.

Although it is suggested that the housing can be provided directly on the former, in place of a standard waste device, such as a sump or trap, the housing can be connected to a sump or trap of a former, either directly or indirectly via intervening pipework.

It is also envisaged that the housing can be a pipe which is connectable inline with a drain system.

Although the invention has been described with reference to a shower-floor former, it is equally applicable to a shower tray, for example being of the level-access variety or with raised sides.

Flow, coupling and clutch operation damping features may also be introduced as modifications.

It is thus possible to provide a pumped shower draining device for a shower installation, which utilises a solely mechanical self-regulating variable-engagement clutch by which an amount of engagement between the pump driving device and the pump element is directly determined by an amount of waste water at or in the clutch. Since the engagement of the clutch varies automatically with the ebb and flow of the waste water in the housing, the dynamic action is cyclic as the pump element follows the flow rate of the waste water.

The embodiments described above are given by way of examples only, and various other modifications will be apparent to persons skilled in the art without departing from the scope of the invention, as defined by the appended claims.

What is claimed is:

1. A pumped shower draining device for a shower installation, the pumped shower draining device comprising a housing having a waste water inlet and a waste water outlet, a pump element provided within the housing, a pump driving device which can drive the pump element, and a variable-engagement clutch which provides variable driving engagement between the pump driving device and the pump element, wherein an amount of engagement imparted by the in use clutch is determined by an amount of waste water flowing from a shower unit of the shower installation that is present in said clutch.

2. A pumped shower draining device as claimed in claim 1, wherein the clutch is self-regulating, so that the amount of engagement is determined by an amount of water in or at the clutch.

3. A pumped shower draining device as claimed in claim 1, wherein the housing forms part of a waste water unit into which water from a surface of a showering area directly drains.

4. A pumped shower draining device as claimed in claim 1, wherein the housing is directly provided on a shower tray or former.

5. A pumped shower draining device as claimed in claim 1, wherein the variable-engagement clutch is a viscous coupling.

6. A pumped shower draining device as claimed in claim 5, wherein the viscous coupling includes a first plurality of concentric rings provided on the pump driving device, and a second plurality of concentric rings provided on the pump element, wherein the first rings are provided in closely spaced alternating relationship with the second rings.

7. A pumped shower draining device as claimed in claim 5, wherein the viscous coupling is provided on a flow path defined in the housing between the waste water inlet and the waste water outlet.

8. A pumped shower draining device as claimed in claim 6, wherein the viscous coupling includes one or more drain channels which drain water from between the first and second concentric rings.

9. A pumped shower draining device as claimed in claim 8, wherein the second concentric rings are provided on a sloping surface to promote draining.

10. A pumped shower draining device as claimed in claim 5, wherein one or more of the first and/or second concentric rings includes a cutting and/or grinding edge which macerates detritus to prevent or reduce blocking of the viscous coupling.

11. A pumped shower draining device as claimed in claim 1, wherein the variable-engagement clutch includes a drive mechanism and a float which engages and disengages the drive mechanism.

12. A pumped shower draining device as claimed in claim 1, wherein a flow path through the housing includes a bypass portion which bypasses the clutch.

* * * * *